United States Patent [19]

Lauria et al.

[11] 4,453,253

[45] Jun. 5, 1984

[54] ELECTRIC ARC FURNACE COMPONENT

[75] Inventors: Anthony T. Lauria; Louis J. Voisinet, both of Berea, Ohio

[73] Assignee: Union Carbide Corporation, Danbury, Conn.

[21] Appl. No.: 272,786

[22] Filed: Jun. 10, 1981

[51] Int. Cl.[3] ..... F27D 1/12

[52] U.S. Cl. ..... 373/74; 373/76; 432/238

[58] Field of Search ..... 373/73–76; 432/238; 266/280, 241

[56] References Cited

U.S. PATENT DOCUMENTS

| | | | |
|---|---|---|---|
| 3,458,641 | 7/1969 | Perucchetti | 373/75 |
| 3,885,082 | 5/1975 | Hanas | 373/76 |
| 3,990,686 | 11/1976 | Iguchi et al. | 373/76 |
| 4,021,603 | 5/1977 | Nanjyo et al. | |
| 4,079,184 | 3/1978 | Bahout et al. | 373/76 |
| 4,091,228 | 5/1978 | Brown, Jr. et al. | |
| 4,097,679 | 6/1978 | Fukumoto et al. | |
| 4,122,295 | 10/1978 | Nanyo et al. | |
| 4,132,852 | 1/1979 | Andoniev et al. | |
| 4,152,534 | 5/1979 | Iwashita | |
| 4,161,620 | 7/1979 | Nakamura | |
| 4,197,422 | 3/1980 | Fuchs et al. | |
| 4,216,348 | 8/1980 | Greenberger | |
| 4,221,922 | 9/1980 | Okimune | |

*Primary Examiner*—Roy N. Envall, Jr.
*Attorney, Agent, or Firm*—Robert C. Cummings

[57] ABSTRACT

Wall and roof sections for electric arc furnaces are made of graphite blocks with removably attached fluid cooled panels.

21 Claims, 7 Drawing Figures

ELECTRIC ARC FURNACE COMPONENT

BACKGROUND OF THE INVENTION

This invention relates to arc furnaces for steel production and the like, and more particularly to fluid cooled blocks for use in the roofs and walls of such furnaces.

Historically electric arc furnaces have been constructed of refractory bricks arranged to form a circular furnace with a refractory brick roof having holes for three graphite electrodes which are suspended above the furnace and lowered into it. An arc is maintained between the electrodes and a pool of molten metal or "melt" at the bottom of the furnace. Ore is charged into the furnace and a molten metal product is tapped from the melt.

The very high temperatures reached in the arc furnace, on the order of 1600° C., result in heavy wear of the refractory brick and the destruction of the furnace in a relatively short time. In a typical electric arc steel furnace the average furnace roof and side walls made of conventional refractory brick survive for approximately 30 to 70 heats, or steel making melts, lasting some 10 to 14 days before they must be replaced. Replacement involves shutting down the furnace, permitting it to cool and then tearing down and replacing the damaged areas of sidewall and roof.

The vulnerability of the traditional refractory brick material to damage from the high temperatures generated inside the typical arc furnace has led to many efforts to either cool the refractory brick or replace it with material better able to withstand the high temperatures. Thus U.S. Pat. No. 4,091,228 describes an apparatus designed to cool the exterior walls of the furnace made of refractory brick, while U.S. Pat. No. 4,132,852 describes such an apparatus for cooling the refractory bricks in a furnace roof. In U.S. Pat. No. 4,152,534 there is taught a roof construction with fluid cooled channels spaced between the refractory bricks in a furnace roof. The attempted cooling of refractory bricks is not a satisfactory procedure however because the refractory materials are thermal insulators and channel little heat to the fluid cooling mechanism.

In U.S. Pat. No. 4,221,922 a somewhat different approach is taken with water cooled metal panels placed inside a conventional refractory brick furnace. According to the patent, a layer of slag forms on the metal surface to protect it from the furnace contents. The problems of maintaining and repairing or replacing such metal panels within the hostile environment of the hot furnace interior are obvious. U.S. Pat. No. 4,097,679 teaches a furnace wall with water cooled panels inside as well as outside.

A number of efforts have been made to substitute fluid cooled metal panels for all or part of the refractory bricks in the furnace walls and roof. Thus U.S. Pat. Nos. 4,122,295 and 4,161,620 each describe and claim water cooled metal wall panels to replace the refractory bricks, while U.S. Pat. Nos. 4,021,603 4,197,422 and 4,216,348 are concerned with water cooled metal roofs. Such metal panels are either welded, and thus susceptible to leaks, or cast iron or the like, with resultant heavy weight which is particularly undesirable in roof structures.

Yet another approach was tried in U.S. Pat. No. 3,990,686 where water carrying boxes were imbedded in a wall of carbonaceous material to cool it. Such a construction provides only limited cooling of the walls and has the further disadvantage that the entire furnace wall must be disassembled if a section wears and the water box must be replaced.

SUMMARY OF THE INVENTION

We have now discovered that an improved electric arc furnace can be constructed by using for all or part of the furnace walls and/or roof, liquid cooled blocks of graphite. According to our discovery, the wall or roof is constructed with blocks of graphite having removably attached panels on their outer surface. These panels contain conduits for circulating a cooling fluid such as water to remove the heat from the graphite blocks. Such liquid cooled graphite blocks last many times longer than conventional refractory bricks and have other advantages as will be seen.

Figure 1:
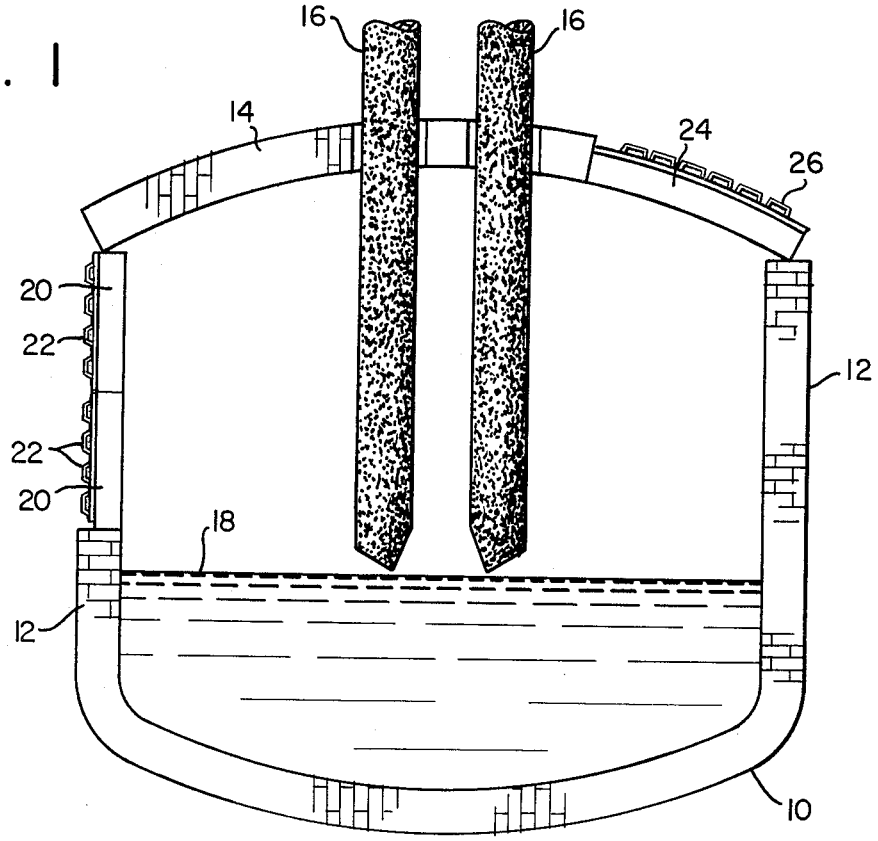
FIG. 1 is a schematic cross section of an arc furnace embodying fluid cooled graphite wall and roof blocks according to the invention.

In FIG. 1 the furnace comprises a bottom 10 of refractory brick surmounted by a conventional refractory brick wall 12. A roof 14 of refractory brick rests on top of the wall 12. Electrodes 16, supported from above, extend through the roof 14 into the furnace to a point just above melt 18 of molten metal. In the drawing one portion of the wall 12 has been replaced by graphite wall blocks 20 having cooling conduits 22 on their surface. In addition one part of the roof 14 has been replaced by a graphite roof block 24 with cooling conduits 26.

Figure 2:
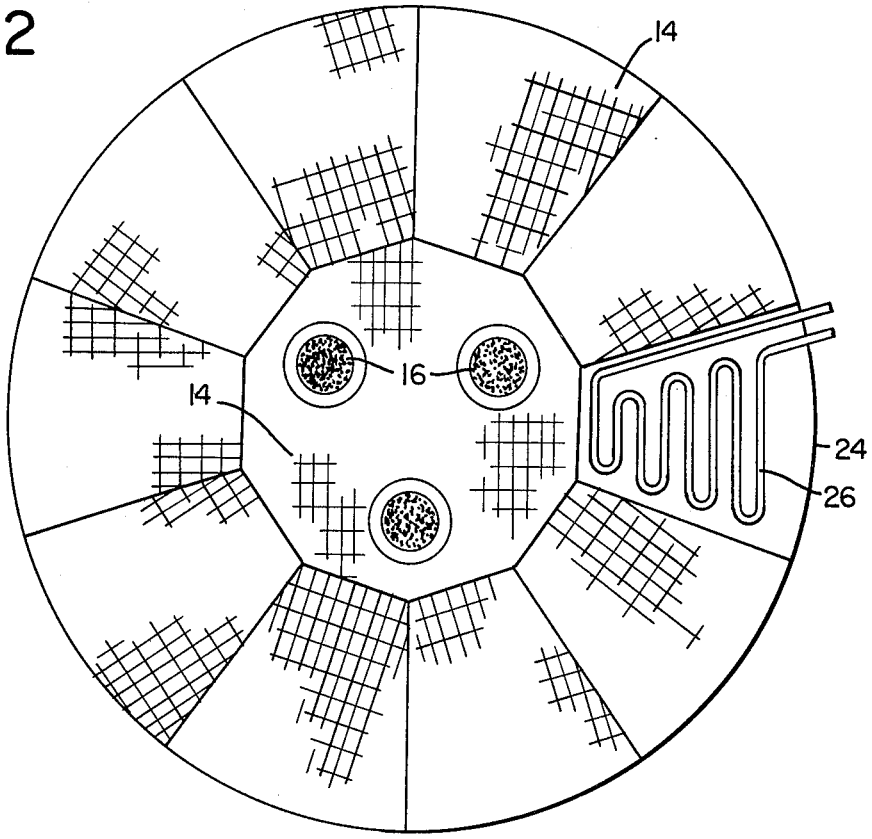
FIG. 2 is a top view of an electric arc furnace showing a fluid cooled graphite block according to the invention substituted for a section of refractory brick.
Figure 3:
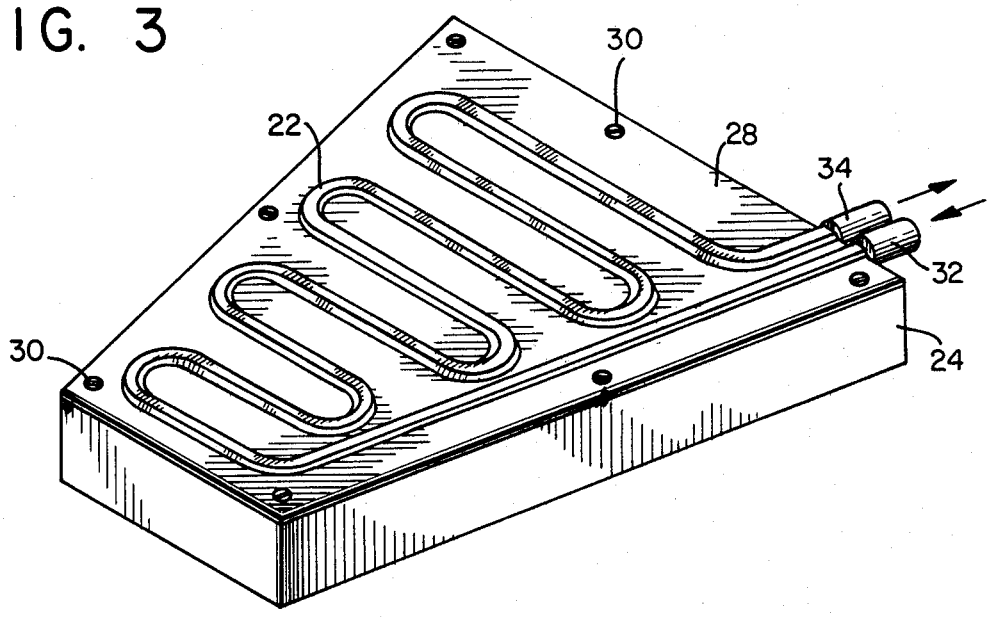
FIG. 3 is an isometric view of a fluid cooled graphite roof block according to the invention.
Figure 4:
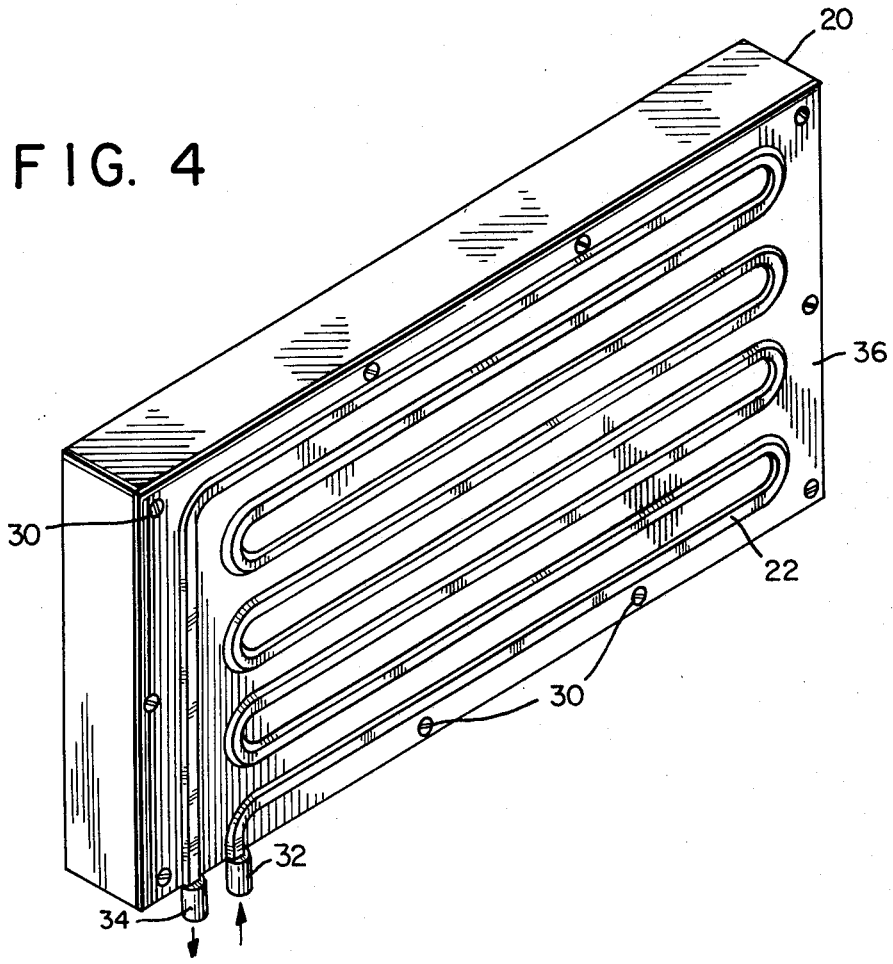
FIG. 4 is an isometric view of a fluid cooled graphite wall block according to the invention.

In FIG. 2 the positioning of a graphite roof block 24 in the roof 14 can be seen. The graphite roof block 24 itself can be seen in more detail in FIG. 3. A roof cooling panel 28 is removably fastened to the roof block 24 with bolts 30. The cooling conduits 22 are integral with the roof cooling panel 28, with cooling fluid entering at entry point 32 and exiting at exit port 34, said ports 32 and 34 being connected to a fluid supply not shown. FIG. 4 shows a graphite wall block 20 with a wall cooling panel 36 removably attached to the graphite wall block 20 with bolt 30. Cooling conduits 22 are integral with the wall cooling panel 36 and have entry port 32 and exit port 34 for cooling fluid from a source not shown.

Figure 5:
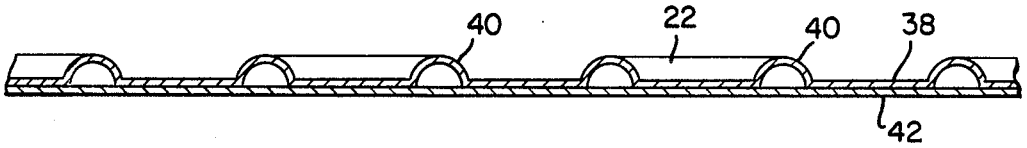
FIGS. 5, 6 and 7 are section views illustrating different particular types of cooling panels according to the invention.
Figure 6:
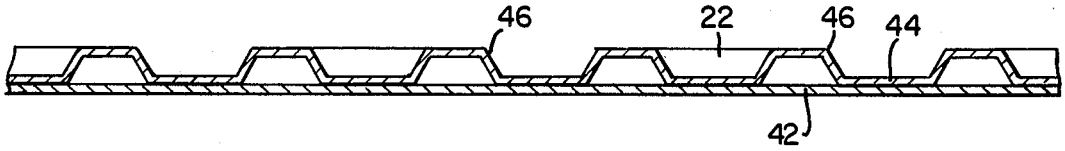
Figure 7:
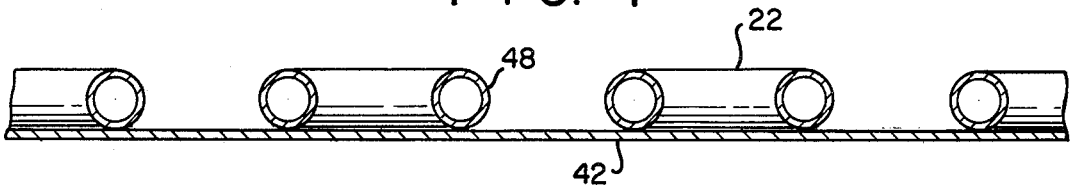

FIG. 5 illustrates a particular type of cooling panel construction for either a roof cooling panel 28 or a wall cooling panel 36 wherein a top sheet 38 with portions raised in a rounded arch 40 is joined to a base panel 42 to form the cooling conduit 22. FIG. 6 illustrates a similar panel in which portions of the top sheet 44 are raised in a straight sided arch 46. Top sheet 44 is joined to base panel 42 to form the cooling conduit 22. In FIG. 7 the cooling conduit 22 consists of tubing 48 secured to a base panel 42.

For purposes of clarity, the invention has been illustrated in the drawing with only a portion of refractory brick wall and roof replaced by liquid cooled graphite blocks. This practice can be followed in commercial production if desired, with only those portions subject to wear, such as the so called "delta" region of the roof where the electrodes enter, having fluid cooled graphite blocks. If desired, however, the entire furnace wall above the melt line and the roof can be replaced by such blocks. Because of energy considerations and potential chemical attack on the graphite, it is not practical to use the fluid cooled blocks of the invention below the melt line.

The fluid cooled panel is preferably made of metal with the particular construction of the conduits a matter of choice. Several appropriate constructions are illustrated in the drawing. The fluid cooled panels 28 and 36 have been shown in the drawing attached to the blocks 20 and 24 with bolts 30, a preferred method of attachment. Other suitable means such as cement or the like could also be employed alone or in combination with bolts or the like, if desired, for the attachment. The preferred cooling fluid is water, however any suitable heat transfer fluid could be used.

The hot face of the graphite block inside the furnace is exposed to temperatures of 1500° C. to 1600° C. With adequate cooling according to the invention, the hot temperatures can be maintained below 1000° C., as low as 600° C. to 800° C. The cold side of the graphite block with the cooling panel attached will be below 100° C. under normal operating conditions. A preferred thickness for the graphite block when placed in the furnace is between three and six inches. The thickness decreases with use. If desired the initial thickness can be much greater, as much as thirteen inches or more, the thickness of conventional refractory brick. The flow rate of cooling fluid through the conduits is preferably the equivalent of between two and five gallons of water per minute per square foot of cooling surface, with the particular rate depending on operating conditions such as temperature, furnace power and the like.

The fluid cooled graphite blocks of the invention provide a practical, economical alternative to the conventional refractory brick and will last many times longer in the furnace. Graphite itself is a refractory material and thus, although the blocks are designed to be operated with cooling fluid circulating through the conduits at all times, an emergency stoppage of fluid flow would do little or no permanent damage if corrected promptly. Unlike metal, if arcing occurs on the hot face of the graphite there will be no burnthrough of the hot face. Thus a fluid cooled graphite block could be used in the delta region where metal blocks would short out. Graphite itself is chemically inert, has no melting point and is unaffected by the lime and FeO dust normally present in an arc furnace. Liquid cooled graphite blocks weigh less than metal ones and graphite is a better thermal conductor which makes it more suitable for automated furnace regulation and voltage tap changes. Generally, also, less fluid is required to cool a graphite block than a metal one.

An important advantage of the present invention derives from the fact that the fluid cooled panel is removably attached to the graphite block and can be readily separated from it when the graphite block becomes too worn for further use. With new graphite blocks substituted from time to time as necessary, the fluid cooled panel will have a long and economical life span of usage. This is in contrast to the one piece fluid cooled metal blocks which are totally destroyed when the integral face is worn out.

What is claimed is:

1. A fluid-cooled graphite block suitable for use as part of the wall or roof of an electric arc furnace which comprises an appropriately shaped block of graphite having in intimate contact with its outer surface a removably fastened fluid-cooled cooling plate having integral conduits for circulating cooling fluid.

2. A fluid-cooled graphite block according to claim 1 wherein said block is so shaped as to be suitable to form a part of the roof of an electric arc furnace.

3. A fluid-cooled graphite block according to claim 1 wherein said block is so shaped as to be suitable to form a part of the side-wall of an electric arc furnace.

4. A fluid-cooled graphite block according to claim 2 wherein said cooling plate has bonded to its surface a cover plate having raised portions forming with said cooling plate channels for the circulation of cooling fluids.

5. A fluid-cooled graphite block according to claim 3 wherein said cooling plate has bonded to its surface a cover plate having raised portions forming with said cooling plate channels for the circulation of cooling fluids.

6. A fluid-cooled graphite block according to claim 2 wherein said cooling plate has bonded to its surface a continuous coil of tubing for the circulation of cooling fluid.

7. A fluid-cooled graphite block according to claim 3 wherein said cooling plate has bonded to its surface a continuous coil of tubing for the circulation of cooling fluid.

8. A fluid-cooled graphite block according to claims 4, 5, 6 or 7 wherein said cooling plate is bolted to said graphite block.

9. A fluid-cooled graphite block according to claims 4, 5, 6 or 7 wherein said cooling plate is metal.

10. A fluid-cooled graphite block according to claim 4 or 5 wherein said cover plate is metal.

11. A fluid-cooled graphite block according to claim 6 or 7 wherein said tubing is metal.

12. An electric arc furnace wherein at least a portion of the furnace roof is constructed of appropriately shaped blocks of graphite having in intimate contact with their outer surfaces removably fastened fluid-cooled cooling plates having integral conduits for circulating cooling fluid.

13. An electric arc furnace wherein at least a portion of the furnace wall above the melt line is constructed of appropriately shaped blocks of graphite having in intimate contact with their outer surfaces removably fastened fluid-cooled cooling plates having integral conduits for circulating cooling fluid.

14. An electric arc furnace according to claim 12 wherein said cooling plates have bonded to their surfaces cover plates having raised portions forming with said cooling plates channels for the circulation of cooling fluids.

15. An electric arc furnace according to claim 13 wherein said cooling plates have bonded to their surfaces cover plates having raised portions forming with said cooling plates channels for the circulation of cooling fluids.

16. An electric arc furnace according to claim 12 wherein said cooling plates have bonded to their surfaces continuous coils of tubing for the circulation of cooling fluid.

17. An electric arc furnace according to claim 13 wherein said cooling plates have bonded to their surfaces continuous coils of tubing for the circulation of cooling fluid.

18. An electric arc furnace according to claims 14, 15, 16, or 17 wherein said cooling plates are bolted to said graphite blocks.

19. An electric arc furnace according to claims 14, 15, 16, or 17 wherein said cooling plates are metal.

20. An electric arc furnace according to claim 14 or 15 wherein said cover plates are metal.

21. An electric arc furnace according to claim 16 or 17 wherein said tubing is metal.

* * * * *